US010669092B2

(12) United States Patent
Mühlemann

(10) Patent No.: US 10,669,092 B2
(45) Date of Patent: Jun. 2, 2020

(54) EGG PACK PRODUCED BY PLASTICS INJECTION MOULDING

(71) Applicant: FOSTAG FORMENBAU AG, Stein am Rhein (CH)

(72) Inventor: Rolf Mühlemann, Schlattingen (CH)

(73) Assignee: FOSTAG FORMENBAU AG, Stein am Rhein (CH)

( * ) Notice: Subject to any disclaimer, the term of this patent is extended or adjusted under 35 U.S.C. 154(b) by 0 days.

(21) Appl. No.: 16/315,496

(22) PCT Filed: Jul. 4, 2017

(86) PCT No.: PCT/EP2017/066629
§ 371 (c)(1),
(2) Date: Jan. 4, 2019

(87) PCT Pub. No.: WO2018/007381
PCT Pub. Date: Jan. 11, 2018

(65) Prior Publication Data

US 2019/0308800 A1 Oct. 10, 2019

(30) Foreign Application Priority Data

Jul. 7, 2016 (CH) ..... 873/16

(51) Int. Cl.
*B65D 85/32* (2006.01)
*B65D 1/36* (2006.01)

(52) U.S. Cl.
CPC ..... *B65D 85/32* (2013.01); *B65D 1/36* (2013.01)

(58) Field of Classification Search
USPC ..... 220/508; 206/521.1, 521.15, 521.6, 206/521.7, 521.8, 521.9
See application file for complete search history.

(56) References Cited

U.S. PATENT DOCUMENTS 1,543,443 A 6/1925 Koppelman
2,634,039 A * 4/1953 Schwertfeger ..... B65D 85/324 206/521.1

(Continued)

FOREIGN PATENT DOCUMENTS

CH 704776 A1 10/2012
CH 705770 B1 5/2013

OTHER PUBLICATIONS

International Search Report dated Aug. 30, 2017 for PCT/EP2017/066629 filed Jul. 4, 2017.

(Continued)

*Primary Examiner* — Jacob K Ackun
(74) *Attorney, Agent, or Firm* — Paul D. Bianco; Fleit Intellectual Property Law

(57) ABSTRACT

An injection molded egg pack has a lower part, with egg holders in an interior, and a lid, integrally formed via a hinge strip and having an at least partially planar lid wall. A releasable closed position of the lid is achieved by lid-fastening means engaging in fastening means of the lower part and a periphery of the lower part engaging in a lid periphery. The lid can be swung in a reproducibly simple manner onto the lower part. This is achieved in that at least one latch-in means is integrally formed on an inner surface of the lid wall, such that it projects away in the direction of a lid plane, and at least one open hollow stub is integrally formed on the lower part, between adjacent egg holders, such that it projects away from the egg holders and a subdivision plane, out of the interior, by way of a stub-opening periphery in such a manner that, in the closed position of the lid, the stub projects out of the interior as far as the inner surface of the lid wall.

12 Claims, 3 Drawing Sheets

(56) References Cited

U.S. PATENT DOCUMENTS

| | | | | |
|---|---|---|---|---|
| 2,776,082 | A * | 1/1957 | Bennorth | B65D 85/325 206/521.7 |
| 3,326,443 | A * | 6/1967 | Burkett | B65D 85/324 206/521.1 |
| 4,742,952 | A * | 5/1988 | Bixler | B65D 85/324 206/521.1 |
| 4,782,995 | A * | 11/1988 | Emery | B65D 85/324 206/521.1 |
| 7,353,951 | B2 * | 4/2008 | Vovan | B65D 71/70 206/521.1 |
| 8,991,604 | B2 * | 3/2015 | Buckley | B65D 85/324 206/521.1 |
| 9,340,343 | B2 * | 5/2016 | Ramirez | B65D 71/0096 |
| 2005/0189256 | A1 * | 9/2005 | St-Onge | B65D 85/32 206/521.1 |
| 2013/0048527 | A1 | 2/2013 | Ramirez et al. | |
| 2015/0028034 | A1 | 1/2015 | Bodmer | |
| 2019/0367221 | A1 * | 12/2019 | Groenveld | B29C 45/14786 |

OTHER PUBLICATIONS

Written Opinion for PCT/EP2017/066629 filed Jul. 4, 2017.
International Preliminary Report on Patentability dated Jan. 8, 2019 with Written Opinion for PCT/EP2017/066629 (English translation).

* cited by examiner

EGG PACK PRODUCED BY PLASTICS INJECTION MOULDING

TECHNICAL FIELD

The present invention describes a one-piece egg pack produced by plastic injection moulding comprising a lower part which has a plurality of egg holders in an interior and a lid which is moulded on integrally via a hinge strip and has an at least partially planar lid wall, wherein the lid is configured to be foldable over the lower part by means of hinge strips and a releasable closed position of the lid on the lower part can be achieved by engagement of lid fastening means into lower part fastening means and a lower part edge engaging in a lid edge.

PRIOR ART

Egg packs or egg boxes or egg cartons have been known for a long time and are available commercially with variously many egg holders. Whereas previously mainly renewable raw materials made of pulp or waste paper were used to produce egg packs, today plastics are used extensively. For hygiene and in some cases legal reasons, it is in some cases forbidden to re-use egg packs.

Nowadays, egg packs are being increasingly produced by means of plastic injection moulding. In this case, as far as possible a one-piece egg pack having a lower part and a lid connected by a hinge strip is injection moulded. A plurality of egg holders are formed in the lower part as cup- or hollow-shaped recesses in which eggs can be stored. The interior of the lower part and the egg holders are in this case shaped in such a manner that the eggs lie in the hollow-shaped egg holders without touching one another. The lid can be brought into a closed position relative to the lower part by pivoting, wherein the eggs are held locally fixed by means of the lid in the interior of the lower part. Usually lid fastening means are arranged on the lid, which can be operatively connected to lower part fastening means arranged on the lower part. In order to achieve a stabilization, the circumferential lid edge and the circumferential lower part edge are also shaped in such a manner that these edges form a stabilized connection in the closed position.

In order to save resources and produce as favourably as possible, the egg packs are produced by injection moulding to have the thinnest possible walls, wherein the dimensional stability of the egg packs suffers. A dimensionally stable egg pack made of a thin-walled plastic material is disclosed in CH705770. The configuration described therein is matched to an injection moulding process which is as optimized as possible and correspondingly expensive and complex. Since egg holders are arranged here in the lower part and in the lid, and due to measures such as the arrangement of reinforcing ribs, the dimensional stability and torsional stiffness can be increased.

Such egg packs are becoming increasingly complex to manufacture as a result of the measures to increase the stability, wherein however the user friendliness is not increased. If a user has filled the egg pack or the individual egg holders with eggs, the lid frequently cannot simply be folded over onto the lower part by means of hinge strips. This can result in tilting of the individual egg holders with respect to one another, if the egg holders are arranged in the lid and lower part. The lid cannot then simply be folded over or can come to rest obliquely with respect to the lower part. Since the hinge strips should also be as thin-walled as possible, a guided folding movement into the closed position is made difficult. If all the egg holders are filled with eggs, folding is then further simplified since the surfaces of the eggs in the egg holders guide and centre the lid to be folded in a supporting manner over the lower part. This dilemma of the lightest possible one-piece egg pack produced by means of plastic injection moulding, which is sufficiently dimensionally stable and allows a simple user-friendly closure of the lid, has not been able to be solved so far. Even when the egg pack has been closed once, it could not be eliminated hitherto as a result of the thin-walled nature that the lid moves relative to the lower part by an undesired amount.

SUMMARY OF THE INVENTION

One aspect of the disclosure relates to a simply configured egg pack which is as thin-walled as possible, the lid of which can be folded reproducibly easily onto the lower part, which is even achieved when the egg pack is not completely filled.

Regardless of the filling state of the egg pack, a specific partially guided folding shut with the lid latching in during closing should be attainable for everyone. Despite the stabilization of the closing, the manufacture of the egg pack using injection moulding should be as material-saving as possible and the egg pack should be one-piece.

Further advantageous embodiments are also disclosed. For example, different forms of the latch-in means are possible and in addition, for stabilized storage of the eggs holder retaining rings are arranged in the egg holders and egg retaining crowns are arranged at corresponding positions of the lid inner surface. Thus a spring-loaded and therefore gentle mounting during transport is achieved.

BRIEF DESCRIPTION OF THE DRAWINGS

A preferred exemplary embodiment of the subject matter of the invention is described hereinafter in connection with the appended drawings.

DESCRIPTION

Figure 1:
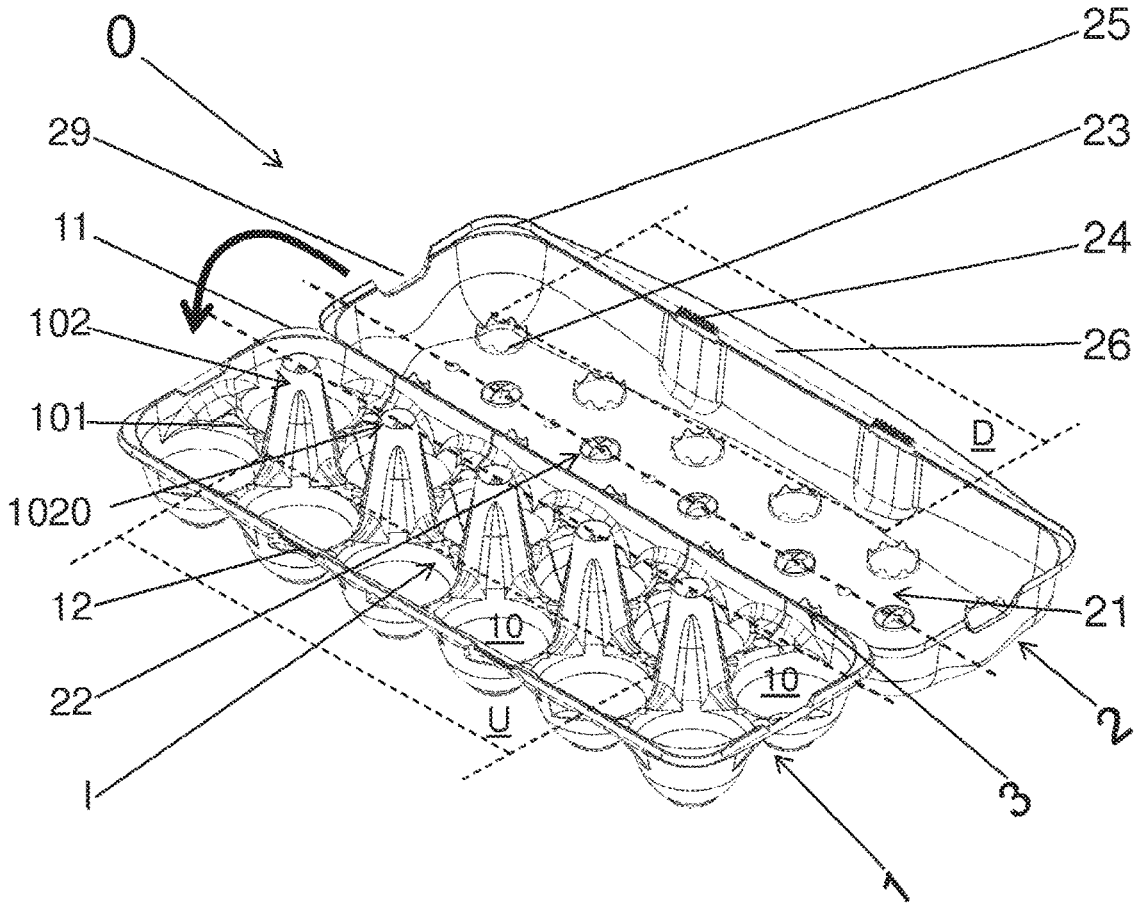
FIG. 1 shows a perspective view of an egg pack in the unfolded state whilst

An egg pack 0 produced by means of plastic injection moulding is disclosed, which egg pack is configured in one piece and comprises a lower part 1, a lid 2 and a hinge strip 3. The egg pack 0 is produced in a plastic injection moulding process, wherein polypropylene is preferably used here. The entire egg pack 0 is made as thin-walled as possible in order to save packing weight and minimize manufacturing costs.

The lower part 1 has a plurality of, here twelve, egg holders 10 which are configured to be cup- or hollow-shaped and in which correspondingly many eggs can be accommodated. The lower part 1 forms an interior I and has a circumferential lower part edge 11, which defines a lower part plane U. The lower part plane U is characterized by a planar plane marked by a dashed line. When an egg is placed in an egg holder 10, a part of the egg then rests in the hollow-shaped egg holder below the lower part plane U whilst the other part projects beyond the lower part plane U. In the course of the lower part edge 11, lower part fastening means 12 are moulded on here, which can be operatively connected to the lid fastening means 24 on the lid. Here the lower part fastening means 12 have the form of recesses in which the lid fastening means 24 in the form of tongues can engage, with the result that the lid 2 can be held in a latchable manner on the lower part 1 in the closed position.

Moulded on between adjacent egg holders 10 are holder connecting webs 101 which run approximately in the lower part plane U and are used to space apart the egg holders 10. At least one hollow stub 102 is arranged on the lower part 1, projecting away from this lower part from a base surface or the base surfaces of the egg holders 10 and the lower part plane U into the interior I. Here a total of five hollow stubs 102 are moulded on between adjacent egg holders 10. The hollow stubs 102 extend approximately from the height of the lower part plane U tapering conically away from the egg holders 10. The wall thickness of the hollow stubs 102 is also configured to be as thin as possible. The termination of the hollow stubs 102 at the end of the hollow stubs 102 remote from the lower part 1 is formed by a stub opening edge 1020. The hollow stubs 102 are configured to be open, wherein an access to the interior of the hollow stub 102 or to the outer side of the lower part 1 exists through the stub opening edge 1020. The hollow stubs 102 are moulded on along a central line of the lower part 1 and point away from the egg holders 10 or the lower part plane U with their stub opening edges 1020. The walls of the egg holders 10, the holder connecting webs 101 and the hollow stubs 102 should naturally be configured to be curved in such a manner that eggs to be inserted can be stored at a distance from one another.

The hinge strip 3, which for example is a film hinge, and therefore indirectly also the lid 2 is moulded onto the lower part 1 produced in one piece. The wall thickness of the film hinge 3 and the lid 2 is also designed to be as small as possible.

The lid 2 comprises at least in part a planar lid wall, which goes over into curved edge regions of the lid 2. A lid edge 25 in which engagement recesses 29 are made here is moulded on circumferentially. A lid plane D is spanned at the height of the lid edge 25, this being indicated by dashed lines. The lid edge 25 cooperates with the lower part edge 11 in the closed position of the lid 2. Accordingly, the lid 2 is pivotable about a pivot axis inside the hinge strip 3 running onto the lower part 1. The scope for pivoting is indicated by means of an arrow. Moulded on the lid edge 25 are lid fastening means 24 which cooperate with the corresponding lower part fastening means 12. Also moulded on the lid edge 25 is an opening tab 26 which projects beyond the lid edge 25 and therefore in the closed position of the lid 2 also beyond the lower part edge 11, with the result that a user can more easily open the egg pack 0.

The lid 2 has a lid inner surface 21 on which latch-in means are arranged, which means project from the lid inner surface 21 in the direction of the lid plane D. The lid inner surface 21 is here designed to be planar, wherein the latch-in means 22 are placed in such a manner that when the lid 2 is folded in the closed position, the hollow stubs 102 or their stub opening edges 1020 can be operatively connected to the latch-in means 22. Here the latch-in means 22 are also arranged along a central line along the lid inner surface 21.

Also arranged along the planar lid inner surface 7 are egg retaining crowns 23 projecting from the lid inner surface 21 in the direction of the lid plane D. These egg retaining crowns 23 have an annular wall, whose wall height is varied in a wave-shaped manner. These egg retaining crowns 23 are also moulded on and the annular walls are designed to be as thin as possible.

In order to increase the stability of the thin-wall lid 2, stabilizing ribs 27 are here moulded on the lid inner surface 21, which ribs run partially in the curved lid region and on the planar lid inner surface 21. Along the longitudinal direction of the lid 2 or the egg pack 0, the stabilizing ribs 27 are arranged at the height of the latch-in means 22 and therefore at the height of the stub opening edges 1020.

Figure 2:
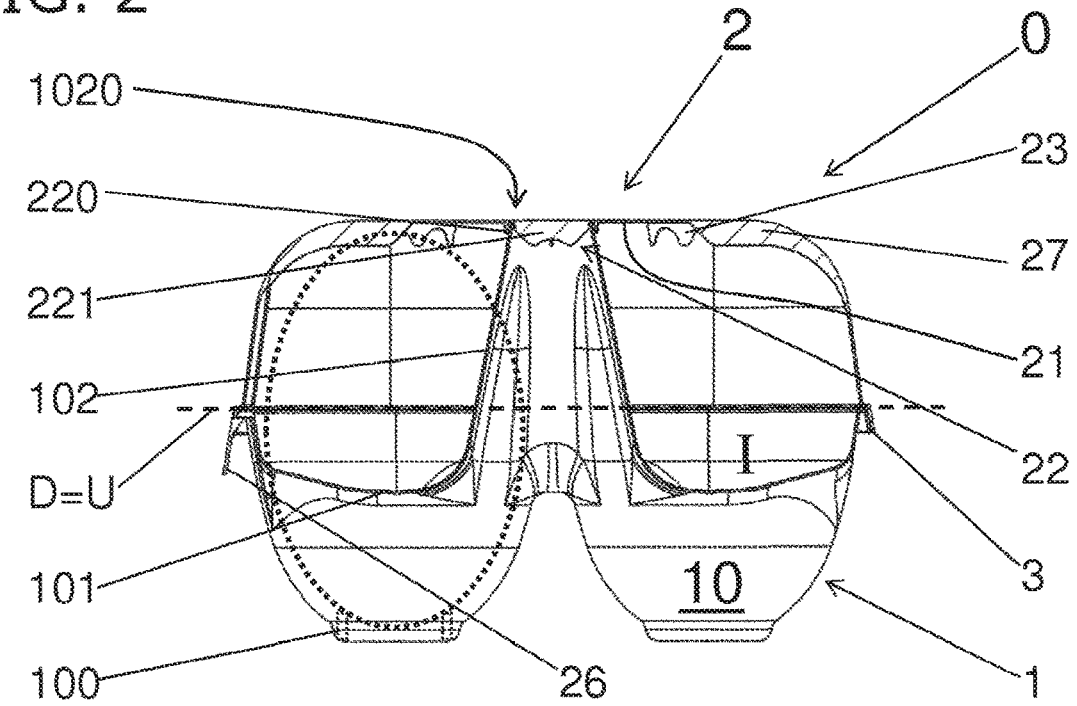
FIG. 2 shows a sectional view of an egg pack in the closed position, wherein hollow stubs and latch-in means are operatively connected.

In FIG. 2 the lid 2 is folded into the closed position by means of hinge strips 3, wherein the lid 2 closes the lower part 1. In the interior I of the lower part 1, eggs are placed in the egg holders 10 projecting through the lower part plane U and the lid plane D. Preferably a holder retaining ring 100 is arranged on the bottom of each egg holder 10 underneath the lower part plane U. When an egg is inserted into an egg holder 10, it rests on the holder retaining ring 100 or on a wall of the holder retaining ring 100 at a distance from the bottom wall of the egg holder 10. As a result of the plastic material, the holder retaining ring 100 ensures a sprung mounting of the egg. Preferably the wall of the holder retaining ring 100 can be configured to be wave-shaped with varying wall height, with the result that material is saved during manufacture.

When the lid 2 is brought into the closed position, the egg retaining crowns 23 come to lie above the egg holders 10 so that the tops of the eggs partially dip into the interior of the egg retaining crowns 23.

Figure 3:
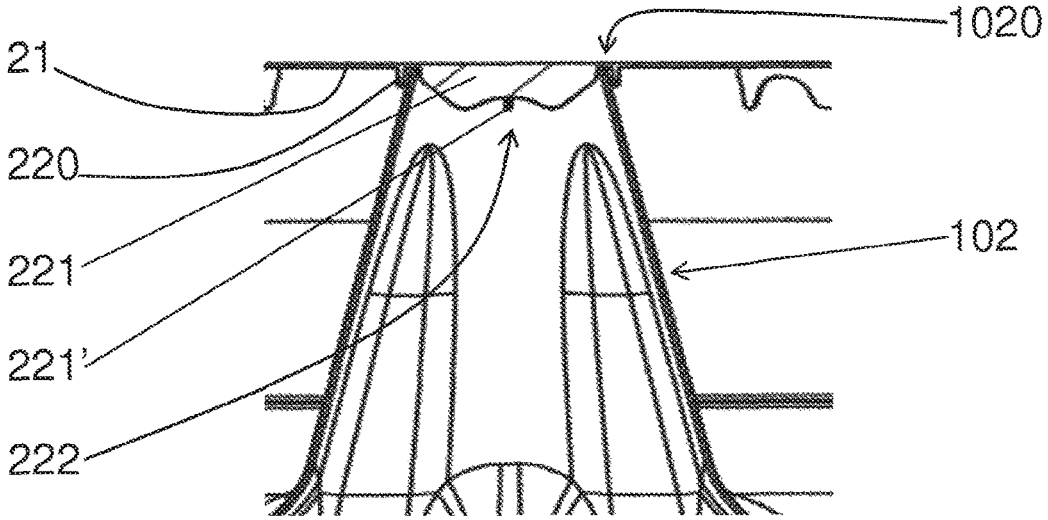
FIG. 3 shows a detailed sectional view of a hollow stub operatively connected with the latch-in means.

In order that the lid 2 can be folded reproducibly simply onto the lower part 1, regardless of the filling state of the egg holders 10, the hollow stubs 102 of the lower part 1 engage in the latch-in means 22 on the lid inner surface 21. At least one centring ring 220 is provided as latch-in means 22, the annular wall of which projects away from the lid inner surface 21. The tip of the hollow stub 102 engages with the stub opening edge 1020 into the inside diameter of the centring ring 220. In FIG. 3 this is shown in detail in enlarged view. The tip of the hollow stub 102 engages in the centring ring 220, wherein the stub opening edge 1020 can project as far as the lid inner surface 21. In the closed position of the lid 2 a stabilized mounting of the hollow stub 102 is accordingly achieved. Since a plurality of hollow stubs 102 and latch-in means 22 are moulded on along the lower part 1 and the lid 2 in lower parts 1 having a plurality of egg holders 10, a stabilized closure is possible.

Preferably the latch-in means 22 have, in addition to the centring ring 220, at least one centring web 221 comprising a web wall which projects away from the lid inner surface 21.

Particularly preferably a centring cross 222 comprising several centring webs 221, 221' is selected as latch-in means 22. This design additionally stabilizes the region of the lid inner surface 21 in which the stub opening edge 1020 comes to lie.

Figure 4A:
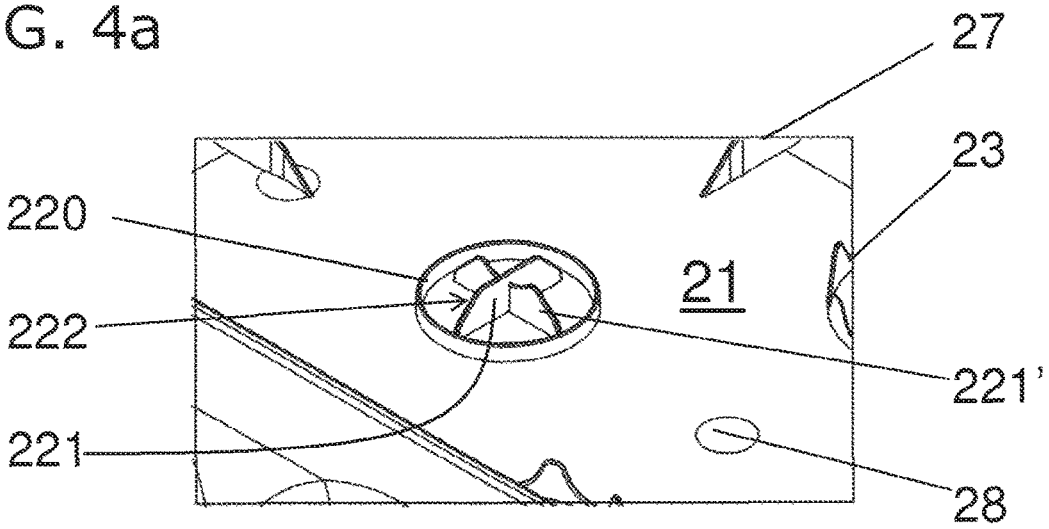
FIGS. 4*a* to 4*c* show perspective detailed views of the lid inner surface with latch-in means in the form of a centring ring and a differently configured centring cross or differently configured centring webs.
Figure 4B:
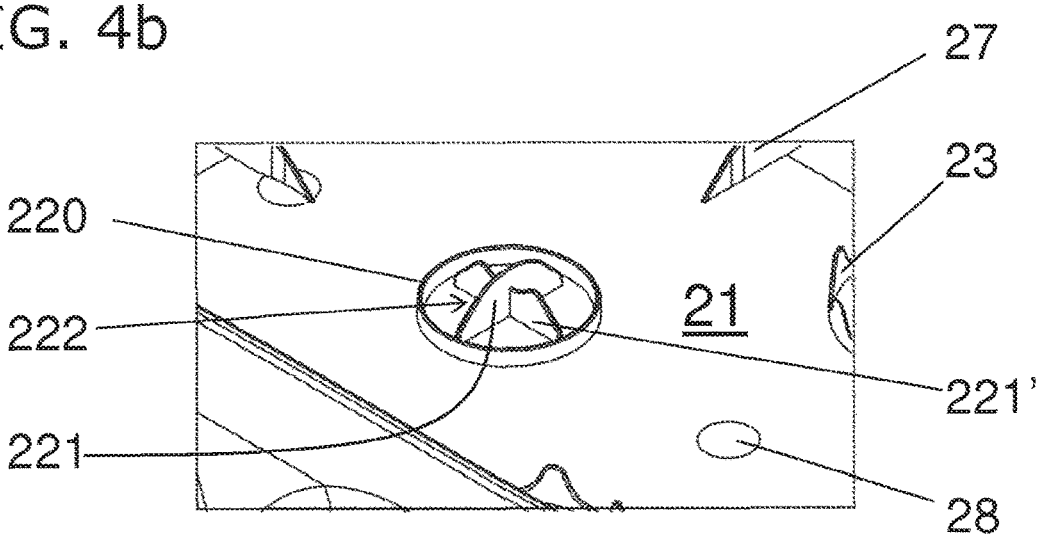
Figure 4C:
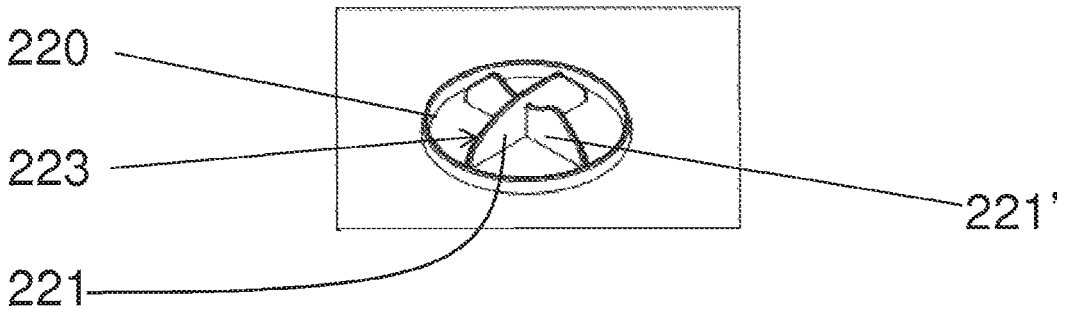

In the embodiment of the latch-in means 22 according to FIG. 4*a*, a centring cross 222 projecting away from the lid inner surface 21 is moulded on in the interior of the centring ring 220, wherein the lateral edges pointing towards the centring ring 220 are bevelled. As a result of this bevelling, the tip of the hollow stub 102 or the stub opening edge 1020 is designed in such a manner that the stub opening edge 1020 is guided between the lateral edges of the centring webs 221, 221' and the annular wall of the centring ring 220. In the variant according to FIG. 4*a*, the front face of a centring web 221 arranged transversely to the longitudinal direction of the egg pack is also configured to run flat parallel to the lid inner surface 21. In the variant according to FIG. 4*b*, the front face of a centring web 221 arranged transversely to the longitudinal direction of the egg pack is formed in a manner bent away from the lid inner surface approximately describing a semicircle. In a further variant shown in FIG. 4*c*, the front face of a centring web 221 arranged transversely to the longitudinal direction of the egg pack can be formed in a manner bent away from the lid inner surface and asymmetrically, wherein this front face has a smaller slope than on the side facing away from the hinge strip 3 for better guidance into the hollow stubs 102 during closing of the egg pack. The variants from FIGS. 4*a* to 4*c* show the advantage that any hooking in of the stub opening edge 1020 can be prevented.

As shown here, ventilation holes 28 passing through the lid wall can be provided. However, these holes do not further influence the stability of the lid 2.

If an egg pack 0 or the egg holders 10 in the lower part 1 are filled with eggs, the lid 2 can simply be folded shut, wherein the tips of the hollow stubs 1020 or the stub opening edges 1020 can be operatively connected guided by the latch-in means 22. The stub opening edges 1020 are introduced into the centring ring 220. By means of the at least one centring web 221 or the centring cross 222, the wall of the hollow stub 102 is guided as far as the lid inner surface 21 and the outer circumference of the stub opening edge 1020 engages in the inner circumference of the centring ring 220, so that a local fixing of the hollow stub 102 can be achieved.

REFERENCE LIST

0 Egg pack (one-piece, injection moulding)
1 Lower part with lower part wall
  10 Egg holder
  100 Holder retaining ring
  101 Holder connecting web
  102 Hollow stub
    1020 Stub opening edge
  11 Lower part edge (circumferential)
  12 Lower part fastening means
U Lower part plane
I Interior
2 Lid
  Planar lid wall
  21 Lid inner surface
  22 Latch-in means
    220 Centring ring
    221 Centring web
    222 Centring cross
    223 Front face hinge strip side
  23 Egg retaining crown
  24 Lid fastening means (engaging tabs)
  25 Lid edge (circumferential)
  26 Opening tab
  27 Stabilizing rib (at height of stubs) (not shown)
  28 Ventilation hole
  29 Engagement recess
D Lid plane
3 Hinge strip

The invention claimed is:

1. A one-piece egg pack produced by plastic injection moulding comprising a lower part which has a plurality of egg holders in an interior and a lid which is moulded on integrally via a hinge strip and has an at least partially planar lid wall, wherein the lid is configured to be foldable over the lower part by hinge strips and a releasable closed position of the lid on the lower part can be achieved by engagement of lid fastening means into lower part fastening means and a lower part edge engaging in a lid edge, wherein at least one latch-in means is moulded on a lid inner surface of the at least partially planar lid wall such that the at least one latch-in means projects away in the direction of a lid plane and at least one open hollow stub is moulded on the lower part between adjacent egg holders such that it the at least one open hollow stub projects away from the egg holders and a lower part plane out of the interior with a stub opening edge in such a manner that in the closed position of the lid the at least one open hollow stub projects from the interior as far as the lid inner surface of the at least partially planar lid wall, wherein the stub opening edge can be operatively connected to the latch-in means and the lid inner surface to thereby achieve a guided latching-in and a local fixing of the hollow stub.

2. The egg pack according to claim 1, wherein the latch-in means comprises at least one centring web which projects away from the lid inner surface in the direction of the line plane, which latch-in means engages in the inner circumference of the stub opening edge of the open hollow stub.

3. The egg pack according to claim 2, wherein the side edges of the at least one centring web are configured to be bevelled.

4. The egg pack according to claim 2, wherein the latch-in means comprise a centring cross comprising two centring webs.

5. The egg pack according to claim 2, wherein a front face of a centring web arranged transversely to the longitudinal direction of the egg pack is configured to run flat parallel to the lid inner surface.

6. The egg pack according to claim 2, wherein a front face of a centring web arranged transversely to the longitudinal direction of the egg pack is bent away from the lid inner surface and shaped so that it approximately describes a semicircle.

7. The egg pack according to claim 2, wherein a front face of a centring web arranged transversely to the longitudinal direction of the egg pack is bent away from the lid inner surface and formed asymmetrically, wherein this front face has a smaller slope on the hinge strip side than on the side facing away from the hinge strip.

8. The egg pack according to claim 1, wherein the latch-in means is a centring ring, in the interior of which the outer circumference of the stub opening edge of the open hollow stub engages.

9. The egg pack according to claim 2, wherein the latch-in means is a centring ring, in the interior of which the outer circumference of the stub opening edge of the open hollow stub engages and wherein the centring web or the centring cross runs inside the centring ring.

10. The egg pack according to claim 1, wherein a holder retaining ring is formed in each egg holder and an egg retaining crown is formed at the opposite positions on the lid inner surface in the closed position of the lid, which egg retaining crown projects away from the lid inner surface in the direction of the lid plane.

11. The egg pack according to claim 10, wherein the walls of the holder retaining rings and the egg retaining crown are configured to be wave-shaped with variable wall height in order to save material.

12. The egg pack according to claim 1, wherein the hollow stub is configured to taper in the course from the lower part plane in the direction of the stub opening edge.

* * * * *